US006135566A

United States Patent [19]

Anderson

[11] Patent Number: 6,135,566

[45] Date of Patent: Oct. 24, 2000

[54] SELF-PROPELLED FLOOR STRIPPER

[76] Inventor: Martin L. Anderson, 6852 Estes Ave. NW., Maple Lake, Minn. 55358

[21] Appl. No.: 09/235,445

[22] Filed: Jan. 22, 1999

[51] Int. Cl.[7] ..... B32B 35/00

[52] U.S. Cl. ..... 299/37.1; 299/36.1

[58] Field of Search ..... 15/93.1, 256.5, 15/256.51; 56/10.8, 11.7, 11.8; 299/36.1, 37.1, 37.2; 180/19.1

[56] References Cited

U.S. PATENT DOCUMENTS

| | | | |
|---|---|---|---|
| 1,167,400 | 1/1916 | Gobiet | 280/855 |
| 2,774,586 | 12/1956 | Becker | 299/37.1 |
| 2,874,946 | 2/1959 | Singleterry et al. | 299/37.1 |
| 2,906,514 | 9/1959 | Becker | 299/37.1 |
| 3,251,629 | 5/1966 | Cawley | 299/37.5 |
| 4,108,268 | 8/1978 | Block | 180/337 |
| 4,162,809 | 7/1979 | Anderson et al. | 299/37.1 |
| 4,483,566 | 11/1984 | Grasse | 299/37.1 |
| 4,626,033 | 12/1986 | Anderson | 299/37.1 |
| 4,683,657 | 8/1987 | Anderson et al. | 30/170 |
| 4,779,301 | 10/1988 | Millette | 15/105 |
| 4,821,357 | 4/1989 | Millette | 15/93.1 |
| 4,882,940 | 11/1989 | Yamaoka et al. | 74/15.66 |
| 4,963,224 | 10/1990 | Anderson | 156/584 |
| 5,009,131 | 4/1991 | Alto et al. | 81/45 |
| 5,209,050 | 5/1993 | Carrigan | 56/16.7 |
| 5,398,767 | 3/1995 | Warke | 172/21 |
| 5,430,906 | 7/1995 | Drury | 15/160 |
| 5,702,161 | 12/1997 | Finney et al. | 299/37.1 |
| 5,830,313 | 11/1998 | Smith | 156/584 |

FOREIGN PATENT DOCUMENTS

NR. 176345 10/1953 Austria .

*Primary Examiner*—Eileen D. Lillis
*Assistant Examiner*—John Kreck
*Attorney, Agent, or Firm*—Nikolai, Mersereau & Dietz, P.A.

[57] ABSTRACT

A self-propelled carpet/tile stripping tool of the walk-behind type includes a drive train including an electric motor coupled through an electromagnetic clutch and a gear reduction box to ground-engaging wheels for advancing the machine in a forward direction when the clutch is energized. The same motor driving the wheels also is coupled to a cutting head member by means of an eccentric drive where the cutting head member is suspended in elastomeric shock mounts to reduce vibration while yet permitting orbital movement of a floor-engaging cutting blade. Finger-tip controls allows selective operation of the drive motor and electromagnetic clutch. The machine is further weighted to increase the frictional engagement between the floor scraper blade and the floor surface and because of the self-propelled aspect, operator fatigue is minimized.

14 Claims, 3 Drawing Sheets

SELF-PROPELLED FLOOR STRIPPER

BACKGROUND OF THE INVENTION

I. Field of the Invention

This invention relates generally to machines for stripping materials, such as adhesive bonded floor coverings from floor surfaces, and more particularly to an improved machine of this type incorporating a novel electric motor drive system for moving the machine's cutting head in an orbital pattern and for driving its wheels and thereby allowing heavier loading of the machine's cutting head on the floor surface which improves the stripping action while reducing the work effort of the operator.

II. Discussion of the Prior Art

Back in 1979, my father was awarded U.S. Pat. No. 4,162,809 on a motorized carpet and tile stripping machine that comprised a box-like housing mounted on a pair of wheels disposed near the rear of the housing and a cutting blade projecting outwardly from the front of the housing and adapted to engage the ground beneath a floor covering that had been adhesively bonded to the floor. Supported on an upper deck of the housing was an electric motor whose output shaft was coupled to the machine's cutting head by means of an eccentric drive shaft such that the cutting head was made to move in an orbital or elliptical pattern. An elongated handle was also affixed to the upper deck of the housing and sloped rearward and upward terminating in handle grips.

When this machine was used to strip a floor covering, such as adhesively bonded carpeting from a concrete floor, the operator would first use a knife to cut the carpeting into strips. Next, the stripping machine would be placed at one end of the cut strip with its cutting head disposed in the interface between the carpeting and floor. The operator would then activate the motor to cause the cutting blade to orbitally rotate while he manually urged the machine forward by pushing against the handle.

While the machine made in accordance with the '809 patent was somewhat effective in its operation, it required a high degree of manual effort and also vibrated excessively making it somewhat difficult to control.

In my earlier U.S. Pat. No. 4,626,033, there is described an improvement I made to my father's design to make the machine easier for an operator to control. Specifically, I added a motion retainer bar assembly between the machine's frame and the cutting head's drive bar to modify the degree of eccentricity between the drive bar and the shaft of the electric drive motor. While this improvement did make the machine somewhat easier to control, vibration remains somewhat excessive and the cutting blade actuation, while separating the carpeting from the floor, left considerable adhesive residue on the floor.

In my later U.S. Pat. No. 4,963,224, I described yet another improvement that I made to the floor stripping machine to reduce vibration. I designed in a pair of OILITE® sleeve bearings and affixed a pair of guide rods to the cutting head and which fit into the sleeve bearings to thereby constrain motion of the cutting head to reciprocatory, back-and-forth movement parallel to the path of travel of the machine. While this improvement did, in fact, reduce machine vibration and prolong its useful life, minimizing its mean time to repair, no improvement was seen in the ability of the machine to remove adhesive residue from the floor following the stripping of the carpet therefrom.

The present invention comprises a still further improvement in floor stripping machines of the type described. I have found that by significantly increasing the downward force of the machine's cutting blade against the floor by drastically increasing the overall weight of the machine, the scraping action of the cutting blade when being pressed down on the floor by the weight of the machine markedly improved its ability to remove adhesive residues. Increasing the weight of the machine, however, would make it that much more difficult for an operator to push. Accordingly, I have developed a drive system for the machine in which the same motor used to drive the cutting blade also drives the machine's wheels, making it self-propelled and reducing the work effort required by the human operator.

SUMMARY OF THE INVENTION

The present invention comprises a self-propelled machine for stripping adhesive-backed floor coverings from floor surfaces. It comprises a generally flat main body plate with an AC motor affixed to the upper surface thereof and the motor's shaft extending through an aperture in the plate and journaled for rotation therein. Also affixed to the main body plate below a lower surface thereof is an axle having a pair of ground-engaging wheels affixed to it where the wheels are disposed along opposed side edges of the body plate. Also affixed to the upper surface of the main body plate is an electromagnetic clutch having an input shaft that extends vertically to the main body plate. A first sprocket wheel is keyed to the aforementioned axle, a second sprocket is keyed to the motor shaft beneath the lower surface of the main body plate and a third sprocket is keyed to the input shaft of the electromagnetic clutch. A first endless belt operatively couples the second sprocket to the third sprocket for driving the input shaft of the clutch.

The drive train further includes a gear reduction box affixed to the main body plate. The gear reduction box has an input shaft and an output shaft. A fourth sprocket is secured to the input shaft of the gear reduction box and a fifth sprocket to the output shaft thereof. A second endless belt operatively couples the output sheave of the clutch to the fourth sprocket and an endless chain couples the fifth sprocket to the first sprocket.

The machine's cutting head is resiliently affixed to the undersurface of the main body plate by shock-mounting members. An eccentric shaft is journaled for rotation in the cutting head member and that eccentric shaft is also connected to the motor shaft, such that energization of the AC motor imparts an orbital movement to the cutting head and energization of the electromagnetic clutch imparts rotation to the machine's ground-engaging wheels.

A housing, including upper and lower cover members join to oppose side edges of the main body plate effectively cover all of the moving parts of the machine except the wheels and the cutting head. The lower cover member also has an eccentric support bearing mounted therein. Heavy steel side weights are affixed to the opposed sides of the upper cover member and a front weight is affixed to the front edge of the main body plate.

An elongated handle has one end pivotally coupled to an upper surface of the upper cover member and the other end of the handle includes hand grips incorporating a pair of electrical control switches for selectively controlling energization of the AC motor and the electromagnetic clutch.

To reduce vibration while still allowing orbital movement of the cutting head, the shock mounting members comprise first and second blocks of rectangular cross-section formed from an elastomeric material of a predetermined durometer. Formed longitudinally through the blocks are cylindrical bores containing sleeve bearings for receiving parallel spaced-apart shafts affixed to the cutting head member.

DESCRIPTION OF THE DRAWINGS

The foregoing features, objects and advantages of the invention will become apparent to those skilled in the art from the following detailed description of a preferred embodiment, especially when considered in conjunction with the accompanying drawings in which like numerals in the several views refer to corresponding parts.

DESCRIPTION OF THE PREFERRED EMBODIMENT

Figure 1:
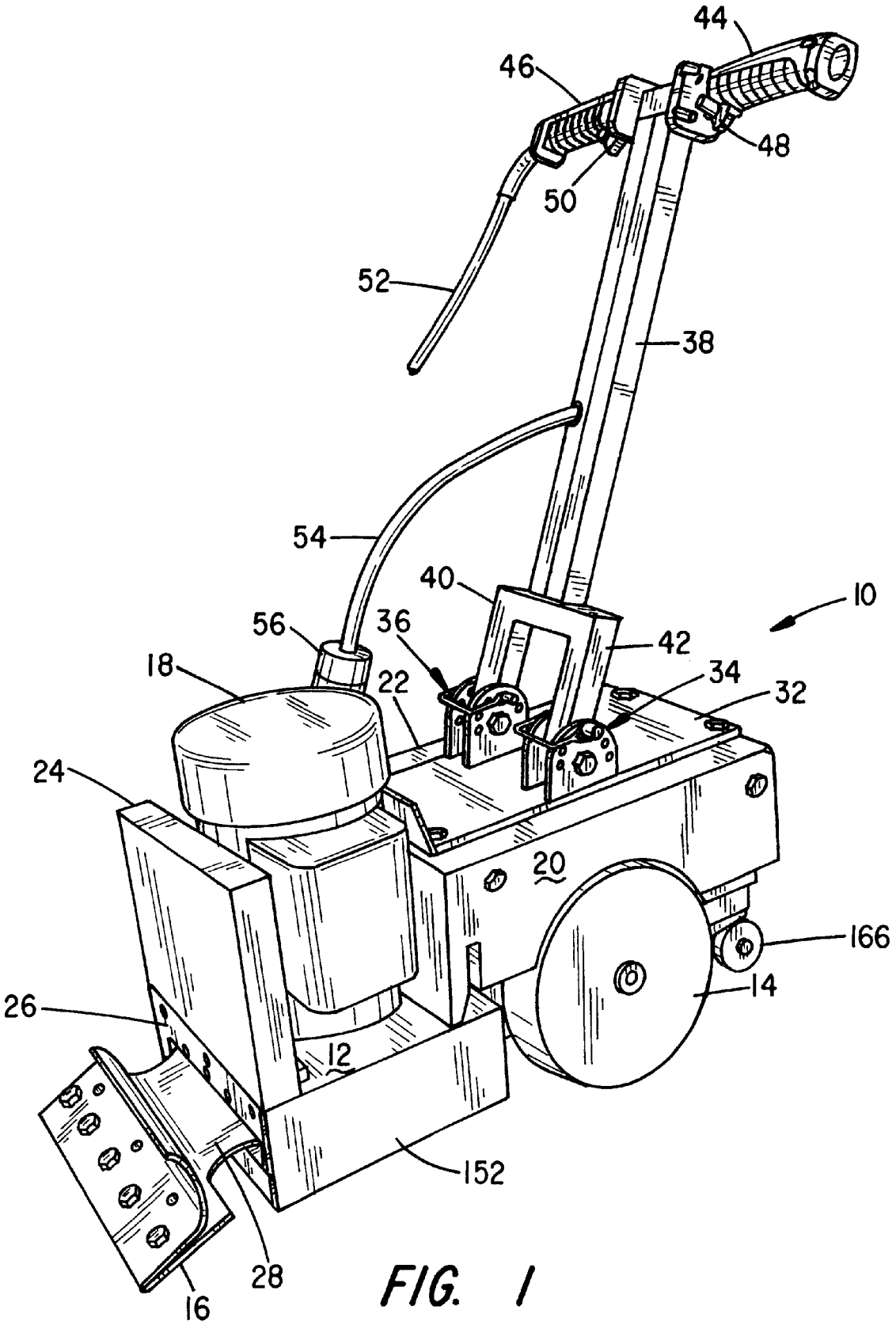
FIG. 1 is a perspective view of the floor covering stripping machine comprising a preferred embodiment of the present invention.

Certain terminology will be used in the following description for convenience in reference only and will not be limiting. The words "upwardly", "downwardly", "rightwardly" and "leftwardly" will refer to directions in the drawings to which reference is made. The words "inwardly" and "outwardly" will refer to directions toward and away from, respectively, the geometric center of the device and associated parts thereof. Said terminology will include the words above specifically mentioned, derivatives thereof and words of similar import.

Referring to FIG. 1, there is indicated generally by numeral 10 a stripping machine for removing adhesively bonded floor coverings from concrete and wood floors and roofing materials from flat building roofs and the like. It may also be used for scraping other debris stuck to flat surfaces. The machine comprises a main body plate 12 supported proximate the rear end thereof by a set of wheels 14 and proximate the front end thereof by a downwardly depending, floor-engaging blade 16. Affixed to the base plate 12 is an AC, capacitive-start motor, 18 whose output shaft extends through bearings mounted in the main body plate 12 so as to extend below the lower surface thereof. Without limitation, the motor 18 may be rated at about 1.5 HP and a speed of about 3400 rpm. As will be further explained, the motor's output shaft is used to drive the cutting blade 16 in a somewhat orbital path and with a majority of its power delivered to the wheels 14 for propelling the stripper along the floor.

To increase the weight of the machine and, therefore, the pressure between the cutting blade 16 and a floor surface, heavy steel side plates 20 and 22 bolt to a housing (not shown in FIG. 1). Similarly, a front weight member 24 bolts to the main body plate 12 proximate a front edge thereof. A front cover plate 26 also bolts to a front edge of the main body plate 12 and extending downwardly from the front cover plate 26 so as to cooperate with the cutting head member 28 is a bearing plate that is not visible in FIG. 1 but is identified by numeral 30 in the exploded view of FIG. 2. The bearing plate 30 is preferably an oilite bearing that remains self-lubricating.

As will be further explained hereinbelow, an upper cover member of the machine housing includes a relatively thick, heavy, steel cover plate 32 having first and second sets of handle brackets 34 and 36 welded to its top surface. The individual brackets in the sets are placed in parallel, spaced-apart relationship such that the bifurcated ends of the machine's handle 38 fit therebetween. The bracket members each have a series of aligned holes formed therethrough, as do the bifurcated ends 40 and 42 of the handle. As such, a pin can be inserted through the aligned holes in each set of brackets to establish the angle at which the handle 38 extends upwardly and rearwardly from the machine to accommodate the stature of a particular operator.

The opposite end of the handle 38 includes laterally extending hand grip members 44–46, each with a built-in electrical switch 48,50 for controlling the operation of the machine 10. A lengthy power cord 52 enters the hand grip 46 and connects through the switches 48 and 50 to a further cord 54 which mates in a plug connector 56 to electrical wires leading to the motor 18 and to an electromagnetic clutch. The clutch is identified in the exploded view of FIG. 2 by numeral 58.

As will be explained hereinbelow, actuation of a first switch 48 will turn on the motor 18 to drive the cutting head member 28 and actuation of the switch 50 will energize the electromagnetic clutch 58 to operatively couple the ground-engaging wheels 14 to the motor's output shaft. Thus, forward motion of the machine 10 has finger-tip control and the operator need only guide the path of travel of the machine and need not provide the force necessary to advance the machine along the floor as the cutting blade 16 separates the floor covering from the floor.

Figure 2:
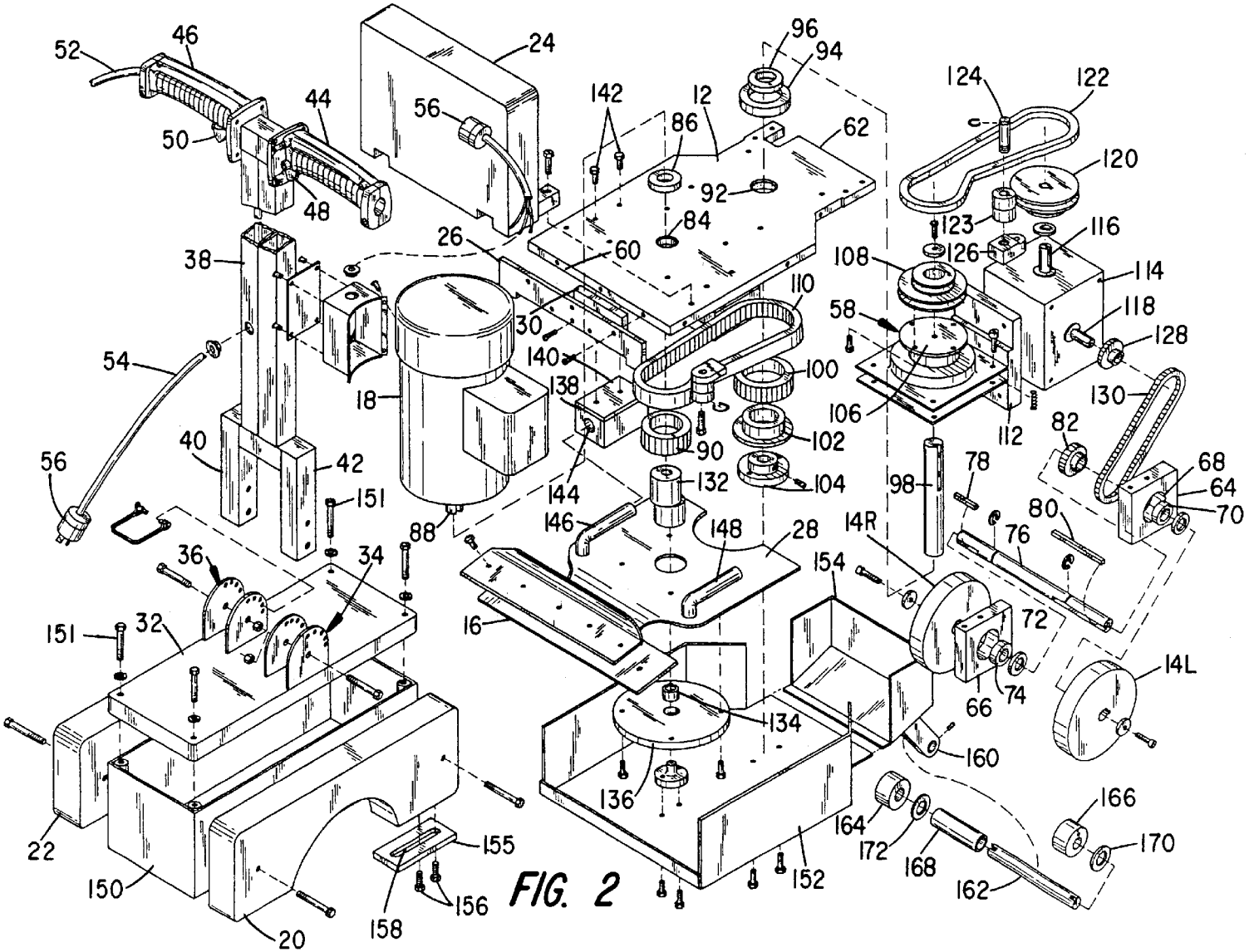
FIG. 2 is an exploded view of the machine of FIG. 1 showing the construction thereof.

Having described, generally, the constructional features of the stripping machine, more detailed information will be presented using the exploded view of FIG. 2.

The main body plate 12 may be a ½ in. steel plate approximately 10 in. wide at its front edge 60 and about 7 in. wide along its rear edge 62. The length dimension of the plate may be about 15.5 in. It is to be understood that these dimensions are for illustrative purposes only and should not be considered as limitive.

Bolted to the undersurface of the main body plate 12, proximate the rear edge 16 thereof, are first and second axle mounting blocks 64 and 66. Fitted into a cylindrical bore 68 formed through the thickness dimension of the axle mounting block 64 is a bearing 70. Likewise, a bore 72 is formed through the thickness dimension of the axle mounting block 66 for receiving a bearing 74. An axle 76 is journaled in the bearings 70 and 74 and the wheels 14L and 14R are keyed to the axle 76 by key members 78 and 80. A first chain sprocket wheel 82 is also mounted on the axle 76 and held fixed thereto by the key member 80.

As earlier mentioned, the motor 18 is bolted to the main body plate 12 above the upper surface thereof. Formed through the thickness dimension of the body plate is a bore 84 that is sized to receive a bearing 86 therein. The bearing 86 journals the motor's output shaft 88 for rotation. Keyed to the motor's output shaft beneath the main body plate 12 is a second toothed pulley or sprocket 90.

A further bore or aperture 92 is formed through the thickness dimension of the main body plate 62 and fitted therein is a clutch bearing 94 and a spacer 96. Fitted through the spacer 96 and bearing 94 is a clutch input shaft 98. Keyed to that shaft is a third pulley or sprocket 100, which surrounds a sheave 102 that is held in place by a lower clutch bearing support member 104. The clutch is preferably the type manufactured and sold by Warner Electric Co. of South Beloit, Ill. The input shaft 98 drives a first clutch plate continuously and when energized, the disk 106 is brought into frictional engagement with that clutch plate, causing the disk 106 to rotate with it. Affixed to the disk 106 is a stepped pulley or sheave 108 and an endless V-belt 110 is deployed about the second and third sprockets, permitting the motor to drive the input shaft 98 of the clutch 58.

Affixed to and projecting upwardly from the upper surface of the main body plate 12 is a gear box mounting block 112 to which a gear reduction box 114 is bolted. The gear reduction box 114 is commercially available from Boston Gear Co. of Quincy, Massachusetts. It includes an input shaft 116 and an output shaft 118. A fourth sprocket or pulley 120 is keyed to the input shaft 116 and an endless belt 122 is deployed about the clutch sheave 108 and the pulley 120. A belt tensioning idler 123 is journaled for rotation on a stub shaft 124 threaded into an idler support 126 to thereby press against the side of the endless belt 122 to thereby inhibit slippage. A fifth sprocket wheel 128 is keyed to the output shaft 118 of the gear reduction box 114. An endless chain 130 is deployed about the first sprocket 82 and the fifth sprocket 128 such that the axle 76 and the wheels 14L and 14R are driven through the gear reduction box 114.

Figure 3:
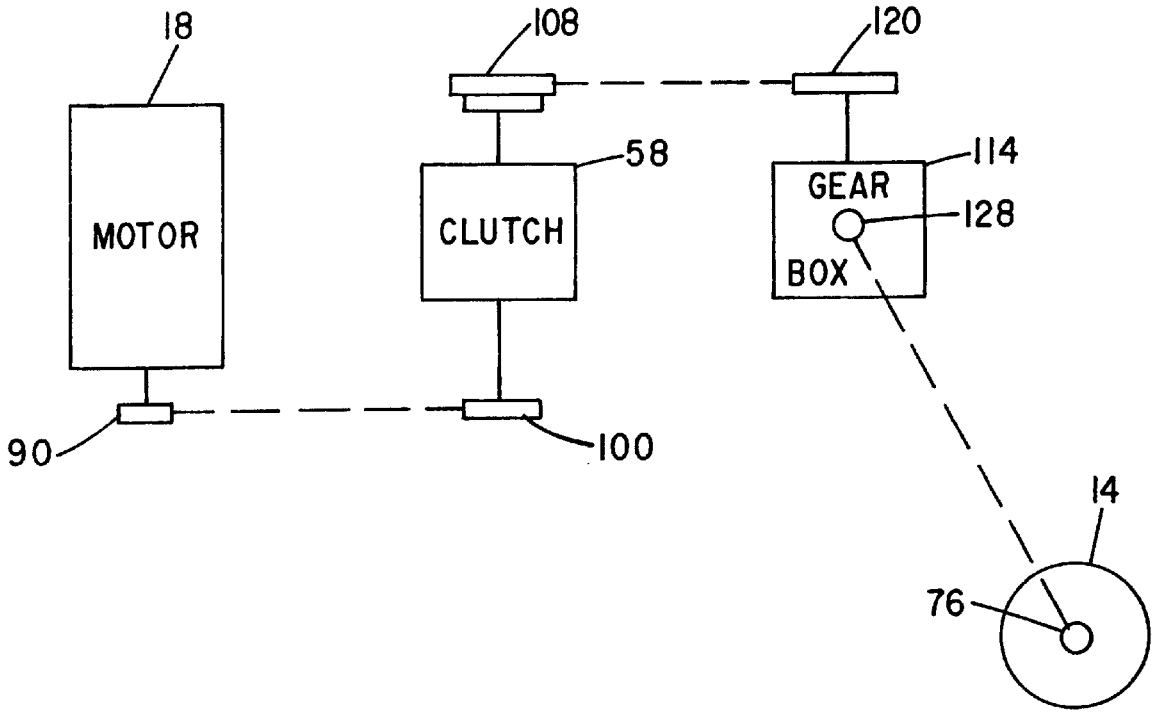
FIG. 3 is a schematic illustration of the drive train incorporated in the preferred embodiment.

Referring momentarily to FIG. 3, the various sprockets may be sized such that with the motor 18 driving the sprocket 90 at 3400 rpm, the sprocket 100 will rotate at about 1200 rpm, as does the clutch output pulley 108. The pulley ratio between clutch sheave 108 and pulley 120 is such that the pulley 120 may rotate at about 600 rpm and with a 60:1 step down provided by the gear reduction box 114, its output sprocket 128 will rotate at about 10 rpm. The diameter of the wheels 14 are such that with the axle 76 rotating at 10 rpm, the machine will traverse the floor at about 30 feet-per-minute. It is possible to modify the speed by shifting the belt 122 on the stepped pulley 108.

Returning again to the exploded view of FIG. 2, affixed to the lower end of the motor's output shaft 88 is an eccentric shaft 132 having offset cylindrical lobes. The bottommost lobe is journaled in a bearing 134 contained within a bearing support plate 136 that is bolted to the undersurface of cutting head member 28.

The cutting head member 28 is supported from the undersurface of the main body plate 12 by means of resilient elastomeric shock-mount members, only one of which is shown and identified by reference numeral 138. The elastomeric members are injection molded onto steel mounting plates 140 having drilled and tapped holes formed therein. Screws, as at 142, pass through drilled holes in the main body plate 12 and into the tapped holes in the mounting plate 140. The shock mounts are located proximate the opposed side edges of the main body plate 12 near its forward edge 60, and each includes a longitudinally extending bore 144 containing a self-lubricating sleeve bearing. Fitted into two sleeve bearings of the two shock mounts are L-shaped slide rods 146 and 148 that are affixed to the cutting head member 28. As the motor 18 drives the eccentric shaft 132, the guide rods 146 and 148 will reciprocate within the bearings of the elastomeric shock mounts and limited side travel is permitted because of the resilient nature of the elastomeric material of the shock mounts that allows them to deflect. Thus, a replaceable floor engaging cutting blade, which is adapted to be clamped between the cutting head member 28 and cutting head cover plate 16 can move in an oval orbit where the major axis of the oval is aligned with the guide shafts 146 and 148.

To shield the working parts of the stripping machine 10, there is provided a housing comprising an upper cover member 150, a lower cover member 152 and a rear cover member 154. The upper cover member is bolted to the upper surface of the main body plate while the lower cover member 152 attaches to the opposed side edges of the main body plate 12. An eccentric support bearing 153 is bolted to the inside surface of the lower cover member in alignment with the eccentric shaft when the lower cover member is bolted in place on the main body plate. The rear cover member 154 attaches to the lower cover member 152 so that in combination, these cover members totally enclosed the moving parts of the machine, save for the cutting head member which projects out through a slotted opening at the front end of the lower cover member 152, as is illustrated in the perspective view of FIG. 1. Side weights 20 and 22 bolt to the side surfaces of the upper cover member 150 and the heavy top plate 32 bolts in covering relation to the otherwise open top of the upper cover member 150 by means of bolts 151.

Slidingly adjustable wheel scrapers 155 attach to an undersurface of the side weights 20 and 22 by means of screws 156 that extend through an elongated slot 158 formed in the scrappers. The leading edge of the scrappers can be brought into close, but non-binding, contact with the wheels 14L and 14R and as the machine is being driven, the scraper plates function to prevent the buildup of carpet/tile, adhesive and other debris on the wheels.

Affixed to the base of the rear cover member 154 are parallel, spaced-apart, downwardly angled legs, only one of which is visible in FIG. 2. It is identified by numeral 160.

The downwardly depending legs 160 support an axle 162 therein and rotatably mounted on the axle 162 are idler wheels 164 and 166 that are held in spaced-apart relation by a tubular spacer 168 and washers 170 and 172.

OPERATION

In use, the operator may wheel the machine 10 to a work site by pulling down on the handgrips 44 and 46 to tilt the machine back onto the idler wheels 64 and 66 as a fulcrum, thereby lifting the ground-engaging wheels 14 and the cutting blade off the floor. The machine can now be pushed to the area where the carpet is to be removed.

The operator will then plug the elongated extension cord 52 into an AC outlet and will slash through the carpet using a walking knife blade to cut the carpeting into strips up to 16 in. wide. Alternatively, the machine may be equipped with a self-scoring blade of the type described in my earlier U.S. Pat. No. 4,683,657, the teachings of which are hereby incorporated by reference. Once the carpeting has been slashed in the manner indicated, the machine 10 will be positioned at one end of the area where the carpeting is to be removed, with the cutting edge of the blade clamped to the cutting head member 28 abutting the floor beneath a first carpet strip. The cutting blade used with machine 10 may have a width dimension in a range of from 1 in. to 12 in. Now, by energizing the switch 48 or 50 controlling the motor 18, the motor will be driven to rotate the eccentric 132 and drive the cutting head in an orbital path. This movement tends to cause the blade to shear the bond between the carpeting and the floor. Next, by depressing the other switch that controls the electromagnetic clutch 58, the wheels 14L and 14R will be driven, via the drive train illustrated schematically in FIG. 3, to advance the machine along the strip of carpeting, removing it from the floor. The downward weight provided by the side weights 20 and 22, the cover plate 32, the front weight 24 and the remaining weight of the machine parts (approximately 350 pounds) force the cutting blade against the floor with considerable pressure such that the adhesive layer is also scraped from the floor.

After making a first pass and removing a strip of carpeting of a predetermined width determined by the selected blade size from the floor, the machine will be moved into position to make another pass and remove another pre-cut or score-as-you-go carpet strip.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention itself.

What is claimed is:

1. A self-propelled machine for stripping adhesive backed floor coverings from floor surfaces, comprising:

(a) a generally flat main body plate having upper and lower surfaces, a front edge, a rear edge and opposed side edges;

(b) an axle journaled for rotation below the lower surface of the main body plate, the axle having a pair of ground engaging wheels affixed thereto along the opposed side edges of the main body plate, the axle further having a first sprocket keyed thereto for rotation in a vertical plane;

(c) an AC motor affixed to the upper surface of the main body plate and having a motor shaft extending through the main body plate and journaled for rotation therein, the motor shaft having a second sprocket keyed thereto beneath the lower surface of the main body plate to rotate in a horizontal plane;

(d) an electromagnetic clutch having an input shaft and an output sheave, the input shaft extending vertically through the main body plate and being journaled for rotation therein, the input shaft having a third sprocket keyed thereto below the lower surface of the main body plate;

(e) a first endless belt operatively coupling the second sprocket to the third sprocket for driving the input shaft of the clutch;

(f) a gear reduction box affixed to the main body plate, the gear reduction box having an input shaft and an output shaft, the input shaft of the gear reduction box including a fourth sprocket keyed thereto and the output shaft of the gear reduction box having a fifth sprocket keyed thereto;

(g) a second endless belt operatively coupling the output sheave of the clutch to the fourth sprocket;

(h) an endless chain operatively coupling the fifth sprocket to the first sprocket;

(i) a cutting head member resiliently affixed to the lower surface of the main body plate by shock mounting members, the cutting head member supporting a floor engaging blade and having an eccentric shaft journaled for rotation therein, the eccentric shaft being connected to the motor shaft whereby energization of the AC motor imparts an orbital movement to the floor engaging blade and energization of the electromagnetic clutch imparts rotation to the pair of ground engaging wheels.

2. The self-propelled machine as in claim 1 and further including a housing including upper and lower cover members joined to the opposed side edges of the main body plate in surrounding relation to the axle, the first, second, third, fourth and fifth sprockets, the output sheave, the first and second endless belts and the endless chain.

3. The self-propelled machine as in claim 2 and further including side weights affixed to opposed sides of the upper cover member and a front weight affixed to the front edge of the main body plate.

4. The self-propelled machine as in claim 2 and further including an elongated handle having first and second ends, the first end being pivotally coupled to an upper surface of the upper cover member, the second end including handle grips incorporating a pair of electrical control switches for controlling energization of the AC motor and the electromagnetic clutch, respectively.

5. The self-propelled machine as in claim 1 wherein the shock mounting members comprise first and second elastomeric blocks of a predetermined durometer value affixed to the lower surface of the main body plate, the blocks including a longitudinal bore extending parallel to a direction of travel of the pair of wheels, the bore having sleeve bearings fitted therein, said cutting head having a pair of parallel, spaced-apart shafts thereon fitted into the sleeve bearings for reciprocating movement.

6. The self-propelled as in claim 4 and further including:

a further axle suspended from and beneath the lower cover member proximate a rear end thereof; and idler wheels journaled for rotation on the further axle, the idler wheels being out of contact with the floor surface when the pair of ground engaging wheels and a floor engaging blade of the cutting head member are in contact with the floor surface, the idler wheels acting as a fulcrum when a downward force is applied to the hand grips in raising the floor engaging blades and the ground engaging wheels from the floor surface.

7. The self-propelled machine as in claim 3 and further including a bearing plate affixed to the front weight and depending downwardly therefrom for engaging the cutting head member to inhibit upward deflection of the cutting head member.

8. The self-propelled machine as in claim 3 and further including first and second scraper plates affixed to the side weights and cooperating with the ground engaging wheels for removing adhesive from said ground engaging wheels.

9. The self-propelled machine as in claim 1 wherein the second sprocket and third sprocket are sized to provide a first predetermined speed reduction of the clutch input shaft relative to the motor shaft.

10. The self-propelled machine as in claim 9 wherein the clutch sheave and the fourth sprocket are sized to provide a second predetermined speed reduction of the input shaft of the gear reduction box relative to the clutch sheave.

11. The self-propelled machine as in claim 10 wherein the gear reduction box provides a third predetermined speed reduction of the fifth sprocket relative to the fourth sprocket.

12. A self-propelled, walk-behind floor stripping machine for removing adhesively bonded floor coverings therefrom comprising:

(a) a frame having a base plate supported proximate a rear edge thereof by a pair of drive wheels affixed to an axle and at a front edge by a floor engaging blade assembly so as to maintain the base plate in a generally horizontal disposition;

(b) an electric motor mounted atop said base plate with a motor output shaft extending through an aperture formed in the base plate;

(c) a crank shaft coupled to the blade assembly and coupled to be driven by the motor output shaft to impart oscillatory motion to the blade assembly;

(d) an electromagnetic clutch with a clutch input shaft coupled to be driven by the motor output shaft and a clutch output shaft to be selectively coupled to the clutch input shaft to be driven therewith; and (e) a gearbox affixed to an upper surface of the base plate, and with a gearbox input shaft coupled to the clutch output shaft and a gearbox output shaft coupled to said axle for driving the pair of drive wheels, the gearbox input shaft being vertically oriented and the gearbox output shaft being horizontally oriented.

13. The self-propelled, walk-behind floor stripping machine of claim 12 and further including:

(a) a plurality of weight members supported on the base plate and above the drive wheels in surrounding relation to the electromagnetic clutch and the gearbox; and (b) an elongated handle member coupled at one end to one of the weight members and having laterally extending hand grips at an opposite end.

14. The self-propelled, walk-behind floor stripping machine as in claim 13 and further including a motor on/off switch and a clutch on/off switch affixed to the hand grips.

* * * * *